US006301335B1

(12) United States Patent
Alfthan et al.

(10) Patent No.: US 6,301,335 B1
(45) Date of Patent: Oct. 9, 2001

(54) ANALYZER MEASURING WINDOW AND METHOD FOR INSTALLING SAID WINDOW IN PLACE

(75) Inventors: Christian von Alfthan, Kauniainen; Kari Mann, Espoo, both of (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/378,984

(22) Filed: Aug. 23, 1999

(30) Foreign Application Priority Data

Sep. 9, 1998 (FI) ..... 981926

(51) Int. Cl.[7] ..... G21K 1/00
(52) U.S. Cl. ..... 378/161; 356/244
(58) Field of Search ..... 378/140, 161; 356/244

(56) References Cited

U.S. PATENT DOCUMENTS 4,178,509 * 12/1979 More et al. ..... 378/161
5,050,201 * 9/1991 Baecklund et al. ..... 378/161

* cited by examiner

*Primary Examiner*—David P. Porta
(74) *Attorney, Agent, or Firm*—Smith-Hill and Bedell

(57) ABSTRACT

The invention relates to an analyzer measuring window and to a method for installing said measuring window in place, said measuring window being used in essentially automatic and continuously operated measurements, particularly when analyzing the element contents of solid, liquid of slurry-like materials. Said measuring window is movable with respect to the measuring aperture provided in the wall of the measuring chamber containing the measuring head of the analyzer and to the sample aperture provided in the sample chamber. According to the invention, the measuring window is made of ribbon-like material (1,31) which is movable in relation to the measuring aperture (6,36) and to the sample chamber (13) in order to replace the measuring window (9, 46) at least between two measuring periods, and in the immediate vicinity of the measuring aperture (6,36), there is installed at least one stretching member (10;37,38) in order to seal the ribbon-like material at least against the wall of the measuring aperture (6,36).

23 Claims, 1 Drawing Sheet

ANALYZER MEASURING WINDOW AND METHOD FOR INSTALLING SAID WINDOW IN PLACE

Figure 1:
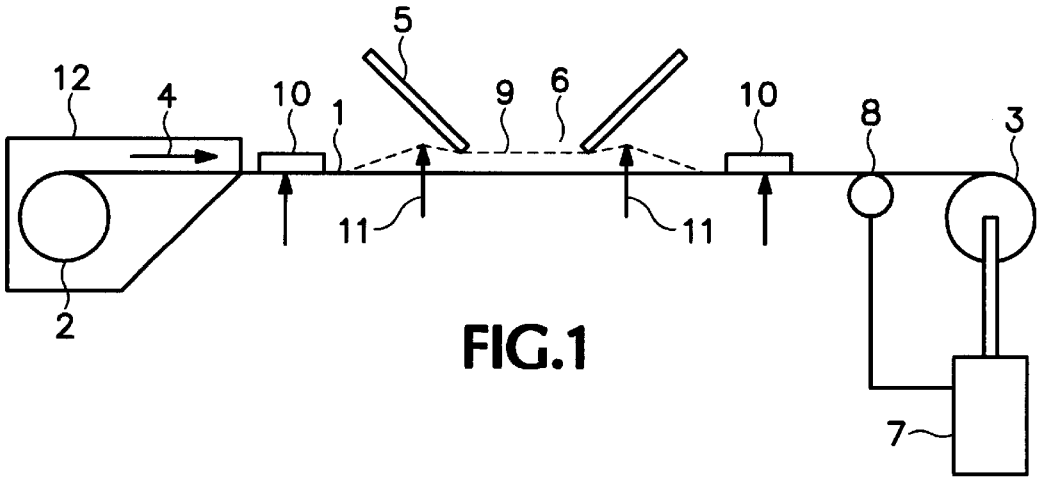

The present invention relates to an analyzer measuring window and to a method for installing said measuring window in place, said measuring window being used in essentially automatic and continuously operated measurements, particularly when analyzing the element contents of solid, liquid or slurry-like materials.

In continuously operated element content measurements, the applied method of analysis is usually the X-ray fluorescence method, where the samples to be analyzed generate, by means of the radiation quantums emitted from the X-ray source, radiation that is characteristic of each element. The intensity of said characteristic radiation is dependent on the element content in the sample, and therefore the radiation intensity is measured by means of a detector which, together with the X-ray source, is installed at the measuring head of the analyzer. In an online analysis, the measuring head is protected by sealing in order to eliminate the effects of surrounding dust and possible changes in the liquid temperature. Particularly when analyzing liquid or slurry-like materials, the sample to be analyzed is located in a specific chamber, and the measuring head is placed in a specific measuring chamber. In order to maintain the connection between the sample chamber and the measuring chamber, the wall of the sample chamber is provided with a sample aperture, and the wall of the measuring chamber is provided with a measuring aperture, and said apertures are mutually positioned so that the measuring chamber and the sample chamber form an essentially closed space. In order to prevent the sample from entering the measuring chamber, and on the other hand from flowing out of the sample chamber, the measuring head provided in the measuring chamber is connected to the sample material contained in the sample chamber by intermediation of a measuring window that permeates X-ray radiation, and said measuring window is installed in between the measuring aperture and the sample aperture.

Generally the measuring window permeating X-ray radiation is made of a thin plastic material, which is tightened to form part of the analyzer wall. The measuring window must be compactly sealed and endure the pressure possibly prevailing in the measuring chamber. The geometric position of the measuring window in relation to the measuring head must essentially remain the same throughout the process, in order to achieve sufficient accuracy in the measurement of the radiation intensities. Thus the measuring window must not be essentially bulged or ballooned, for instance owing to the pressure possibly prevailing in the measuring chamber.

In continuously operated measurements, the measuring window wears for instance when the sample flows past the measuring window, or when solids are precipitated on the window surface, in which case there is an error in the analysis results owing to the measuring window. Therefore the measuring window must be replaced from time to time. If the measuring window is not replaced, it wears until it breaks, or then the degree of errors in the analysis results essentially weaken the measuring accuracy. Usually measuring windows are disposable, and they are replaced manually when necessary. In practice, the replacing of measuring windows is the most important and often the most frequent maintenance operation required by analyzers, which in part increases the analyzer operation and maintenance costs.

The above described process of replacing measuring windows is simplified in the U.S. Pat. No. 5,050,201, where the measuring head of a device applying X-ray fluorescence is protected by means of a film that is movable with respect to the sample. The film is arranged to rest on two spools, so that when necessary, the film can be advanced in order to obtain a new, clean film surface in front of the measuring head. According to the U.S. Pat. No. 5,050,201, the film is kept in place, in readiness for operation, only by means of the friction between the film and the supporting spools. Thus the film is easily advanced when necessary, but on the other hand a film installed in this fashion does neither separate the sample tightly from the measuring head nor prevent the sample from flowing out of the sample chamber, and it certainly does not provide any protective sealing for the measuring head. Moreover, the film according to the U.S. Pat. No. 5,050,201 does not endure any pressure directed to the measuring head or surrounding it. Consequently the measuring accuracy of the device is weakened, because the position of the film in relation to the measuring head is subjected to alterations.

The object of the present invention is to eliminate some of the drawbacks of the prior art and to achieve an improved analyzer measuring window, which is more reliable in operation and is suited for solid, liquid or slurry-like materials, as well as a method for installing said measuring window in place; said measuring window can be replaced at least between two measuring periods without manual operation, and the position of the window in relation to the measuring head can be maintained essentially permanent throughout the whole measuring period. The essential novel features of the invention are apparent from the appended claims.

The analyzer measuring window according to the invention is advantageously used in an online-type analysis of element contents where X-ray fluorescence is applied, and where the sample to be analyzed is advantageously contained in a specific sample chamber and the measuring head is located in a specific measuring chamber. In order to maintain the connection between the sample chamber and the measuring chamber, the wall of the sample chamber is provided with a sample aperture, and the wall of the measuring chamber is provided with a measuring aperture, and said apertures are mutually positioned so that the measuring chamber and the sample chamber form an essentially closed space. In order to prevent the sample from entering the measuring chamber, particularly when treating liquid or slurry-like materials, and on the other hand from flowing out of the sample chamber, the measuring head located in the measuring chamber is connected to the sample material contained in the sample chamber by intermediation of a measuring window permeating X-ray radiation, and said measuring window is installed in between the measuring aperture and the sample aperture.

According to the invention, the analyzer measuring window is formed of a ribbon made of elastic measuring window material, and said ribbon is movable in relation to the analyzer measuring head and can be installed in an essentially compact fashion against the wall of the measuring chamber containing the measuring head and against the wall of the sample chamber containing the material to be analyzed. The ribbon constituting the analyzer measuring window is advanced, during the measuring window replacing period between two measuring periods, essentially for an equal length. Moreover, because the ribbon constituting the analyzer measuring window can be installed in an essentially compact fashion with respect to the walls of the measuring chamber and the sample chamber, the measuring window advantageously remains, throughout the whole measuring period, essentially in place in relation to the measuring head. Thus the measuring accuracy of the analyzer also remains essentially the same throughout the measuring period. In addition, the measuring window is stretched tight with respect to the walls of the measuring chamber and the sample chamber, so that the measuring window is made to endure the pressure directed to the measuring window by the measuring chamber, in which case the bulging of the window surface during the measuring period is prevented by said measuring window.

In order to install the analyzer measuring window according to the invention in place in an essentially compact fashion with respect to the walls of the measuring chamber and the sample chamber, and at the same time in the desired position in relation to the measuring head, any sample possibly present in the sample chamber is removed, and the ribbon constituting the measuring window that was locked in place during the measuring period is released and the ribbon is advanced for a desired length, so that an essentially clean part of ribbon is obtained at the measuring window. In order to lock the ribbon constituting the measuring window in place for the measuring period, the edges of the ribbon part designed as the measuring window are first pressed against a counterpiece. Thereafter the ribbon is tightened by pressing and stretching. The tightened ribbon part constituting the measuring window and the corresponding aperture of the sample chamber are pressed against each other, in which case the ribbon part constituting the measuring window is set in a locked position, essentially compactly with respect to the sample chamber wall. At the same time, the position of the ribbon part locked in place in relation to the measuring head is maintained essentially permanent throughout the measuring period.

The installation of the measuring window according to the invention is advantageously carried out so that the edges of the ribbon part are attached in place and the ribbon part is stretched by means of at least one stretching member, so that in relation to the measuring chamber, said stretching member is located around the measuring aperture provided in the measuring chamber wall. Thus the ribbon part constituting the measuring window can be attached in place, around the measuring aperture provided in the measuring chamber wall. The stretching member as such is advantageously composed of two opposite stretching elements, which are mutually installed so that the ribbon part constituting the measuring window can be placed in between said stretching elements. Advantageously one of the stretching elements is provided with at least two protruding horns, and the other stretching element is provided with a corresponding number of grooves, wherein the horns can advantageously be inserted. Among the grooves provided in the stretching element, the one located on the outer side in relation to the measuring aperture is advantageously essentially narrow, whereas the groove located on the inner side in relation to the measuring aperture is wider than the outer groove. When the opposite stretching elements of the stretching member around the measuring aperture are essentially simultaneously started to move towards each other, the outer groove of the stretching element first attaches the edge of the measuring window area of the ribbon constituting the measuring window in an essentially compact and immovable position. Thereafter the inner groove of the stretching element tightens the middle part of the measuring window area, as the mutual motion of the stretching elements is continued. Thus the new measuring window is sealed in place in a locked position. Thereafter the measuring chamber and the sample chamber are moved towards each other, so that also the sample chamber is sealed in relation to the measuring window.

In order to advance the analyzer measuring window according to the invention in between two measuring periods, the ribbon used as the measuring window material is installed supported on two spool-like members, so that while moving the ribbon from one spool-like member to another, the ribbon proceeds past the measuring aperture provided in the wall of the measuring chamber containing the measuring head. When the ribbon used as the measuring window material is started to be advanced in order to replace the measuring window in the measuring aperture of the measuring chamber, the ribbon is spooled out of the spool-like member located first in the proceeding direction of the ribbon, so that the ribbon can be spooled onto the spool-like member located second in the proceeding direction of the ribbon. Advantageously the second spool-like member in the proceeding direction of the ribbon is provided with a winding mechanism whereby the ribbon used as the measuring window material can be advanced from the first spool-like member to the second spool-like member for a length that corresponds to the desired ribbon length in order to create a measuring window in the measuring aperture of the measuring chamber. Advantageously the ribbon winding mechanism is installed so that thereby the length advanced by the ribbon can be measured irrespective of how much ribbon there is for instance left in the first spool-like member, when seen in the proceeding direction of the ribbon. Moreover, the first spool-like member in the proceeding direction of the ribbon and that part of the ribbon that is left in between the first spool-like member when seen in the proceeding direction of the ribbon and the first stretching element of the ribbon, when seen in the proceeding direction of the ribbon, are both installed in an essentially closed case-like member, which prevents the ribbon from getting dirty, for instance by possible splashes of the material to be analyzed, prior to its implementation as the measuring window.

The analyzer measuring window according to the invention is replaced either regularly at given intervals or on the basis of the X-ray intensities measured through the measuring window. When the measuring window should be replaced, the measuring chamber is emptied of any sample to be analyzed possibly contained therein, and the locking of the measuring window is released. Then the ribbon employed as the measuring window material is advanced by means of the winding mechanism provided in the spool-like member for a desired length, so that unused ribbon is obtained at the measuring aperture of the measuring chamber. Advantageously the desired length is measured by a sensor which measures the rotation angle of the spool-like member connected to the winding mechanism. The sensor measuring the angle of rotation also is advantageously used for detecting any disturbances in the operation of the mechanism, as well as a possible ending of the ribbon. When the ribbon used as the measuring window material is advanced for a desired length, and unused ribbon is obtained at the measuring aperture of the measuring chamber, the measuring window is stretched in place and retightened, and the measuring function is restarted.

Figure 2:
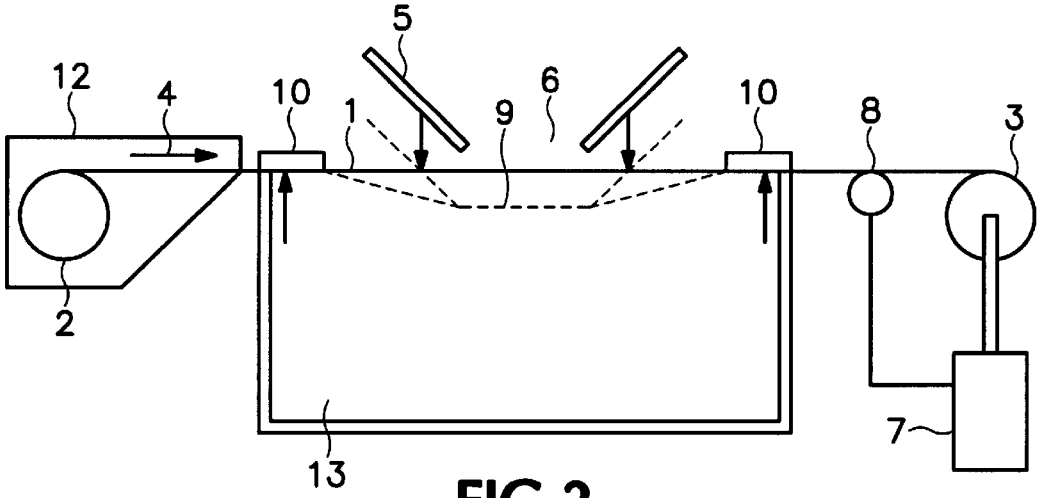
Figure 3:
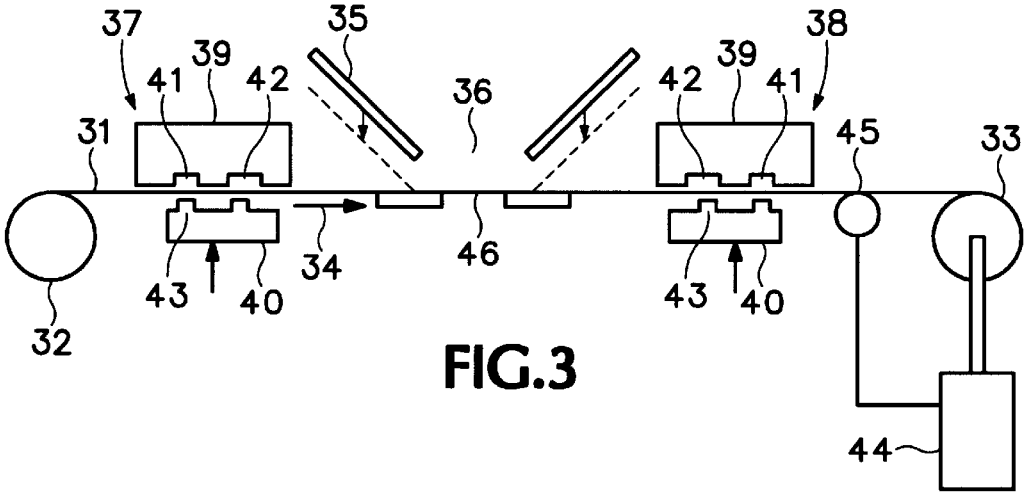

The invention is explained in more detail below, with respect to the appended drawings, wherein FIG. 1 is a schematical illustration of the principles of a preferred embodiment of the invention, FIG. 2 is a schematical illustration of the principles of another preferred embodiment of the invention, and FIG. 3 is a schematical illustration of the principles of a third preferred embodiment of the invention, seen in cross-section from the side.

According to FIG. 1, the ribbon 1 serving as the measuring window material is installed supported on two spools 2 and 3, so that in relation to the proceeding direction 4 of the ribbon, the ribbon 1 coming from the first spool 2 passes in the vicinity of the measuring aperture 6 of the measuring chamber 5. The second spool 3 in the proceeding direction 4 of the ribbon is provided with a winding member 7 which turns the spool 3 in order to advance the ribbon 1. In the winding member 7, there is connected a measuring sensor 8, which is installed in the immediate vicinity of the ribbon 1, so that the measuring sensor 8 measures the length that the ribbon 1 has proceeded. Moreover, the drawing includes a protecting member 12, which protects the spool 2 and the yet unused ribbon 1, located in the immediate vicinity thereof, from getting dirty prior to its implementation as the measuring window 9.

When the ribbon 1 should be stretched and tightened in the measuring aperture 6 as the measuring window 9, the winding member 7 connected to the spool 3 advances the ribbon 1 for the length measured by the measuring sensor 8. After the ribbon 1 stops, the edge of the ribbon part 1 designed as the measuring window 9 is attached around the measuring aperture 6 by means of stretching members 10. The ribbon part 1 designed as the measuring window 9 is stretched and thereafter sealed against the wall of the measuring aperture 6 by deviating the ribbon 1 from the plane defined by the stretching members 10 so that the middle region of the ribbon part 1 designed as the measuring window 9 is pressed towards the wall of the measuring aperture 6 by pushing members 11. Thus the measuring window 9 is compactly sealed against the wall of the measuring aperture 6, and the pushing members 11 are locked in the locking position and the measuring operation proper is started.

The embodiment according to FIG. 2 differs from the one illustrated in FIG. 1 in that separate pushing members are not needed, but the measuring chamber 5 and the sample chamber 13 are moved towards each other, which tightens the ribbon 1 and creates a compact sealing against the wall 6 of the measuring aperture. Thereafter the measuring chamber 5 is locked in place, and the measuring operation proper is started.

In the embodiment according to FIG. 3, the ribbon 31 serving as the measuring window material, is installed supported on two spools 32 and 33, so that in the proceeding direction of the ribbon, the ribbon 31 coming from the first spool 32 proceeds past the measuring aperture 36 of the measuring chamber 35 so that the ribbon part 46 serving as the measuring window can be tightly sealed against the wall of the measuring aperture 36. In order to perform the tightening, the vicinity of the measuring aperture 36, around said measuring aperture 36, there are installed stretching members 37 and 38, so that one of the stretching members 37 is located before the measuring aperture 36 in the proceeding direction 34 of the ribbon, and the second stretching member 38 is located after the measuring aperture 36. The stretching members 37 and 38 comprise two stretching elements 39 and 40, which are located on different sides of the ribbon 31 and are installed symmetrically in the measuring aperture 36. In the stretching elements 39, which according to FIG. 3 are located on that side of the ribbon 31 which is nearest to the measuring aperture 36, there are formed two grooves 41 and 42, of which grooves the one 41 that is located outermost in relation to the measuring aperture 36 is narrower than the one 42 which is located innermost in relation to the measuring aperture 36. The stretching elements 40, which according to FIG. 3 are installed on that side of the ribbon 31 which is located furthest from the measuring aperture 36, are provided with two protrusions 43 being essentially similar in cross-section, and these protrusions 43 are designed to serve as the counterpieces of the grooves 41 and 42 provided in the stretching elements 39.

When replacing the measuring window in the measuring aperture 36, the locked position of the stretching members 37 and 38 of the measuring window is released, and the ribbon 31 is advanced by means of the winding member 44 connected to the spool 33 for a given length, which is measured by the sensor 45 connected to the winding member 44, so that at least in between the stretching members 37 and 38, there is obtained clean ribbon 31. Thereafter the edge of the ribbon part 31 designed as the measuring window is stretched by means of the outer grooves 40 provided in the stretching elements 39 and by means of the protrusion 43 provided in the stretching element 40, when the stretching element 40 is pushed towards the stretching element 39. Simultaneously the ribbon part 31 designed as the measuring window is attached in place by means of the inner grooves 42 provided in the stretching elements 39 and the protrusion 43 provided in the stretching element 40. When the stretching elements 39 and 40 are pressed against each other, the stretching elements 37 and 38 are locked and the measuring chamber 35 is pushed towards the ribbon part 31, in which case the wall of the measuring chamber 36 gets into contact with the ribbon part 46 designed as the measuring window. Thus the measuring window 46 made of the ribbon part 31 is sealed compactly against the wall of the measuring chamber 35. When the measuring window formed of the ribbon part 31 is thus installed in place, the measuring operation proper can begin.

In the above specification we have mainly explained how the analyzer measuring window according to the invention should be attached and locked in place in the measuring aperture of the analyzer measuring head, but the attaching and locking of the analyzer measuring window according to the invention can also be carried out so that the measuring window is attached and locked against the walls of the sample aperture located in the sample chamber, and the accordingly attached and locked measuring window is advanced, by moving the sample chamber, in an advantageous position with respect to the measuring aperture of the measuring chamber containing the analyzer measuring head.

What is claimed is:

1. An analyzer for use in essentially continuous measurement, said analyzer comprising:

a measuring chamber having a wall formed with a measurement aperture, a sample chamber defining a sample aperture, a strip of ribbon-like material including a first length segment serving as a measuring window between the measurement aperture and the sample aperture, said strip of ribbon-like material being movable relative to the measurement aperture and the sample chamber to replace said first length segment with a second length segment of said strip of ribbon-like material, and at least one stretching member in the vicinity of the measurement aperture for sealing the ribbon-like material against the wall of the measuring chamber.

2. An analyzer according to claim 1, comprising first and second spools positioned with the measurement aperture therebetween, and wherein opposite ends of the strip of ribbon-like material are wound on the first and second spools respectively.

3. An analyzer according to claim 2, wherein the first spool is a takeup spool and the analyzer includes a winding member for driving the takeup spool and effecting movement of the strip of ribbon-like material relative to the measurement aperture.

4. An analyzer according to claim 3, wherein the analyzer further comprises a sensor for measuring movement of the strip of ribbon-like material, the sensor being connected to the winding member.

5. An analyzer according to claim 2, comprising a protective case in which the second spool is located.

6. An analyzer according to claim 1, wherein the stretching member comprises first and second stretching elements and the strip of ribbon-like material passes through the stretching elements.

7. An analyzer according to claim 1, comprising first and second stretching members defining a plane for the strip of ribbon-like material, said plane being spaced from the wall of the measuring chamber, and pushing members for pressing the strip of ribbon-like material against the wall of the measuring chamber.

8. An analyzer according to claim 1, comprising first and second stretching members defining a plane for the strip of ribbon-like material and wherein the measuring chamber is movable transverse of said plane to engage the strip between the stretching members and press the strip out of said plane.

9. An analyzer according to claim 1, comprising first and second stretching members, each stretching member being composed of first and second jaws which are movable towards each other for gripping the strip of ribbon-like material and simultaneously placing the strip under tension, and wherein the measuring chamber is movable towards the strip of ribbon-like material between the stretching members to seal the wall against the strip of ribbon-like material.

10. In an analyzer for use in essentially continuous measurement, the analyzer including a measuring chamber having a wall formed with a measurement aperture and a sample chamber defining a sample aperture, a measuring window between the measurement aperture and the sample aperture, the measuring window comprising a first length segment of a strip of ribbon-like material that is movable relative to the measurement window and the sample chamber to replace said first length segment with a second length segment of said strip of ribbon-like material, and a stretching mechanism in the vicinity of the measurement aperture for sealing the ribbon-like material against the wall of the measuring chamber.

11. An analyzer according to claim 10, comprising first and second spools positioned with the measurement aperture therebetween, and wherein opposite ends of the strip of ribbon-like material are wound on the first and second spools respectively.

12. An analyzer according to claim 11, wherein the first spool is a takeup spool and the analyzer includes a winding member for driving the takeup spool and effecting movement of the strip of ribbon-like material relative to the measurement aperture.

13. An analyzer according to claim 12, wherein the analyzer further comprises a sensor for measuring movement of the strip of ribbon-like material, the sensor being connected to the winding member.

14. An analyzer according to claim 11, comprising a protective case in which the second spool is located.

15. An analyzer according to claim 10, wherein the stretching mechanism comprises first and second stretching members, each stretching member comprises first and second stretching elements, and the strip of ribbon-like material passes between the first and second stretching elements.

16. An analyzer according to claim 10, wherein the stretching mechanism comprises first and second stretching members defining a plane for the strip of ribbon-like material, said plane being spaced from the wall of the measuring chamber, and pushing members for pressing the strip of ribbon-like material against the wall of the measuring chamber.

17. An analyzer according to claim 10, wherein the stretching mechanism comprises first and second stretching members defining a plane for the strip of ribbon-like material and wherein the measuring chamber is movable transverse of said plane to engage the strip between the stretching members and press the strip out of said plane.

18. An analyzer according to claim 10, wherein the stretching mechanism comprises first and second stretching members, each stretching member being composed of first and second jaws which are movable towards each other for gripping the strip of ribbon-like material and simultaneously placing the strip under tension, and wherein the measuring chamber is movable towards the strip of ribbon-like material between the stretching members to seal the wall against the strip of ribbon-like material.

19. A method of replacing the measuring window of an analyzer comprising a measuring chamber having a wall formed with a measurement aperture, a sample chamber defining a sample aperture, and a measuring window between the measurement aperture and the sample aperture, wherein the measuring window comprises a first length segment of a strip of ribbon-like material that is movable relative to the measurement window and the sample chamber, said method comprising:

moving the strip of ribbon-like material relative to the measurement window and the sample chamber to replace said first length segment with a second length segment of said strip of ribbon-like material, and stretching the second length segment of ribbon-like material and sealing the second length segment of ribbon-like material against the wall of the measuring chamber.

20. A method according to claim 19, comprising measuring movement of the strip of ribbon-like material.

21. A method according to claim 19, comprising attaching the second length segment of the strip of ribbon-like material at its ends, stretching the second length segment intermediate its ends, and sealing the second length segment against the wall of the measuring chamber.

22. A method according to claim 19, comprising retaining the second length segment of the strip of ribbon-like material in a plane spaced from the wall of the measuring chamber, and advancing the wall of the measuring chamber into contact with the second length segment.

23. A method according to claim 19, comprising retaining the second length segment of the strip of ribbon-like material in a plane, and advancing the second length segment into contact with the wall of the measuring chamber.

* * * * *